US005966158A

United States Patent [19]

Ebata et al.

[11] Patent Number: 5,966,158

[45] Date of Patent: Oct. 12, 1999

[54] SHEET FEEDING APPARATUS

[75] Inventors: Tokihide Ebata; Hideaki Takada, both of Kawasaki, Japan

[73] Assignee: Canon Kabushiki Kaisha, Tokyo, Japan

[21] Appl. No.: 07/751,087

[22] Filed: Aug. 28, 1991

[30] Foreign Application Priority Data

Aug. 30, 1990 [JP] Japan ..... 2-228897
Sep. 29, 1990 [JP] Japan ..... 2-262286

[51] Int. Cl.[6] ..... B41J 13/00

[52] U.S. Cl. ..... 347/104

[58] Field of Search ..... 346/134, 140 R; 271/9, 225, 184, 902, 9.09; 400/642, 646, 647, 647.1, 636, 605; 347/104

[56] References Cited

U.S. PATENT DOCUMENTS

| | | | |
|---|---|---|---|
| 4,043,550 | 8/1977 | Phillips et al. | 271/233 |
| 4,147,341 | 4/1979 | Wurscher et al. | 271/122 |
| 4,279,504 | 7/1981 | Brown et al. . | |
| 4,313,124 | 1/1982 | Hara . | |
| 4,345,262 | 8/1982 | Shirato et al. . | |
| 4,395,118 | 7/1983 | Komori et al. . | |
| 4,404,568 | 9/1983 | Kikuchi et al. . | |
| 4,417,350 | 11/1983 | Ito et al. . | |
| 4,436,406 | 3/1984 | Murasaki et al. | 271/9 X |
| 4,437,656 | 3/1984 | Onodo et al. . | |
| 4,463,359 | 7/1984 | Ayata et al. . | |
| 4,540,268 | 9/1985 | Toyono et al. . | |
| 4,618,134 | 10/1986 | Kawaguchi et al. | 271/9 |
| 4,619,388 | 10/1986 | Ono et al. . | |
| 4,651,224 | 3/1987 | Watanabe | 358/285 |
| 4,653,743 | 3/1987 | Ebata et al. | 271/124 |
| 4,657,375 | 4/1987 | Watanabe et al. . | |
| 4,699,366 | 10/1987 | Kashimura et al. . | |
| 4,723,129 | 2/1988 | Endo et al. . | |
| 4,740,796 | 4/1988 | Endo et al. . | |
| 4,929,105 | 5/1990 | Hirayama et al. | 409/625 |
| 5,019,839 | 5/1991 | Watanabe et al. | 346/134 |
| 5,177,547 | 1/1993 | Kanemitsue et al. | 271/9.09 X |

FOREIGN PATENT DOCUMENTS

| | | | |
|---|---|---|---|
| 0327124 | 8/1989 | European Pat. Off. . | |
| 0332873 | 9/1989 | European Pat. Off. . | |
| 0366143 | 5/1990 | European Pat. Off. . | |
| 3442627 | 5/1985 | Germany . | |
| 3723391 | 9/1986 | Germany . | |
| 5959482 | 4/1984 | Japan . | |
| 0137675 | 7/1985 | Japan | B41J 13/00 |

OTHER PUBLICATIONS

Grafstein, P. and Schwarz, O.B., *Pictorial Handbook of Technical DEvices,* Chemical Publishing Co., Inc., NY, 1971, pp. 6–7.

*Primary Examiner*—N. Le
*Assistant Examiner*—J. Nguyen
*Attorney, Agent, or Firm*—Fitzpatrick, Cella, Harper & Scinto

[57] ABSTRACT

A sheet feeding apparatus comprising, a feeding device for pinching a sheet and for selectively performing an operation for temporarily stopping a sheet supplied from an upstream side by abutting a leading end of the sheet against a nip of the feeding device and then feeding the sheet toward a downstream side and an operation for feeding a sheet supplied from the downstream side toward the upstream side; a guide mechanism shiftable between a first position near the nip to direct the sheet supplied from the upstream side to the nip of said feeding device, and a second position far away from the nip than the first position; and a biasing mechanism for biasing the guide mechanism to the first position when the feeding device feeds the sheet supplied from the upstream side toward the downstream side and for biasing the guide mechanism to the second position when the feeding device feeds the sheet supplied from the downstream side toward the upstream side.

34 Claims, 14 Drawing Sheets

SHEET FEEDING APPARATUS

BACKGROUND OF THE INVENTION

1. Field of the Invention

The present invention relates to a sheet feeding apparatus incorporated into an image forming system such as a printer, copying machine and the like.

2. Related Background Art

In an image forming system such as a printer, copying machine and the like utilizing an ejection tray as a manual sheet supply means, a pair of feed rollers selectively performing operations for feeding a sheet supplied from an upstream side toward a downstream side and for feeding a sheet supplied from the downstream side toward the upstream side are provided as a sheet feeding means. The sheet feeding means normally has guides for directing a leading end of the sheet supplied from the upstream side to a nip between the paired feed rollers.

FIGS. 13 to 15 shows a printer wherein the ejection tray is used as the manual sheet supply means. FIG. 13 shows a condition where a sheet $S_1$ in a sheet supply cassette 1 is supplied (condition that the sheet $S_1$ is supplied from the upstream side), FIG. 14 shows a condition where a sheet $S_2$ is manually supplied from an ejection tray 2 (condition that the sheet $S_2$ is supplied from the downstream side), and FIG. 15 shows a condition where the sheet $S_2$ manually supplied from the ejection tray 2 is temporarily stopped on the sheet supply cassette 1.

Within a printer frame 3, substantially at a central portion thereof, there is disposed a print head 7 for printing an image on the sheet $S_1$ or $S_2$ by discharging liquid droplets while shifting along guide rails 5, 6. At an upstream side of the print head, there are disposed a pair of feed rollers 9, a convey guide 10, and a sheet supply roller 11 in order. On the other hand, at a downstream side of the print head 7, there are disposed a pair of ejector roller 12.

Further, the sheet supply cassette 1 in which the sheets $S_1$ are stacked is attached to one side (right side in FIG. 13) of the printer frame 3 (which cassette can be withdrawn in a direction shown by the arrow A in FIG. 13) and the ejection tray 2 is attached to the other side (left side in FIG. 13) of the printer frame.

The pair of feed rollers 9 selectively performs an operation for feeding the sheet $S_1$ supplied from the upstream sheet supply cassette 1 toward the downstream side and an operation for feeding the sheet $S_2$ manually supplied from the downstream ejection tray 2 toward the upstream side. When the sheet $S_1$ supplied from the sheet supply cassette 1 is fed, an upper roller 9*a* of the paired feed rollers 9 is rotated in a clockwise direction, whereas, a lower roller 9*b* is rotated in an anti-clockwise direction. On the other hand, when the sheet $S_2$ manually supplied from the ejection tray is fed, the upper roller 9*a* of the paired feed rollers 9 is rotated in the anti-clockwise direction, whereas, the lower roller 9*b* is rotated in the clockwise direction.

The convey guide 10 comprises an upper guide 10*a* and a lower guide 10*b* which are secured to the printer frame 3 and which serve to direct a leading end of the sheet $S_1$ supplied from the sheet supply cassette 1 to a nip between the paired feed rollers 9 (FIG. 13).

A lever 16 (FIG. 14) for detecting the presence/absence of the sheet $S_1$, $S_2$ is attached to a smaller diameter portion 15 of the ejector rollers 12 in a sheet passing area. The lever 16 can be rocked around a support shaft 17 in an up-and-down direction and is normally biased by a coil spring 19 so that a trailing end of the lever is pulled downwardly and an arcuate leading end portion 16*a* is positioned slightly higher than a nip between the paired ejector rollers 12. Accordingly, when the leading end of the sheet $S_1$ supplied from the sheet supply cassette 1 or the sheet $S_2$ manually supplied from the ejection tray 2 is pinched by the nip between the paired ejector rollers 12, the arcuate end portion 16*a* of the lever 16 is lowered around the support shaft 17 in opposition to the coil spring 19. Consequently, a photosensor (not shown) is blocked, thus emitting a sheet presence signal.

A manual sheet supply guide 20 is attached to the ejection tray 2. The guide plate 20 is pivotally mounted on the ejection tray 2 via a support shaft 21. A free end 20*a* of the guide plate 20 is connected to a plunger 22 (FIG. 14) out of the sheet passing area. When the plunger 22 is turned ON (energized), as shown in FIG. 14, the free end 20*a* of the guide plate 20 is shifted upwardly to a position confronting to the nip between the paired ejector rollers 12; whereas, when the plunger 22 is turned OFF, the free end 20*a* of the guide plate 20 is lowered by its own weight to a position in parallel with the ejection tray 2, as shown in FIG. 13.

The printer is provided with a cassette supply mode switch and a manual supply mode switch (both not shown). When the cassette supply mode is selected, the pair of feed rollers 9 take the attitude or posture that they can perform the operation for feeding the sheet $S_1$ supplied from the sheet supply cassette 1 toward the downstream side, and the pair of ejector rollers 12 take the attitude that they can eject the sheet. In this case, the guide plate 20 on the ejection tray 2 is returned to the condition shown in FIG. 13. On the other hand, when the manual supply mode is selected, the guide plate 20 on the ejection tray 2 is shifted to the condition shown in FIG. 14.

Next, the operations of the printer in the cassette supply mode and in the manual supply mode will be explained.

FIG. 13 shows a condition that the cassette supply mode is selected. When the cassette supply mode switch is turned ON, the sheet supply roller 11 is rotated in a clockwise direction to supply the sheet $S_1$ from the sheet supply cassette 1. The sheet $S_1$ is guided by the upper and lower guides 10*a*, 10*b* of the convey guide 10 so that the leading end of the sheet is directed to the nip 13 between the feed rollers 9. After the leading end of the sheet $S_1$ is abutted against the nip 13, the sheet is further conveyed by the sheet supply roller 11 to form a loop in a space within the convey guide 10. Then, the sheet $S_1$ is fed toward the downstream side by the pair of feed rollers 9, and an image is printed on the sheet by means of the print head 7 in a print area 23. Thereafter, the sheet $S_1$ is ejected, by the paired ejector rollers 12, onto the ejection tray 2 through an ejection opening 25.

FIG. 14 shows a condition when the manual supply mode is selected. When the sheet $S_2$ is manually inserted into the printer frame 3 along the lifted guide plate 20, a leading end of the sheet $S_2$ is abutted against the nip between the ejector rollers 12. Consequently, the arcuate end portion 16*a* of the lever 16 is pivoted downwardly, whereby the photo-sensor (not shown) emits the sheet presence signal. By this sheet presence signal, the paired ejector rollers 12 and the paired feed rollers 9 are rotated reversely to feed the sheet $S_2$ manually supplied from the downstream ejection tray 2 toward the upstream side. Accordingly, the sheet $S_2$ manually inserted from the guide plate 20 is fed toward the upstream side by means of the pair of ejector rollers 12 and then is further fed toward the upstream side by means of the pair of feed rollers 9. When the sheet $S_2$ passes through the feed roller pair 9, it is introduced between the sheet supply roller 11 and an uppermost sheet in the cassette 1 while being guided by the upper and lower guides 10*a*, 10*b* of the convey guide 10, as shown in FIG. 9.

When the sheet $S_2$ manually supplied from the guide plate 20 of the ejection tray 2 is fed to a position shown in FIG. 15, the sheet is temporarily stopped at that condition. In this condition, the trailing end of the sheet $S_2$ has passed through the print area 23 and is pinched by the nip 13 of the feed roller pair 9. In order to position the trailing end of the sheet $S_2$, for example, a count is started after the trailing end of the sheet $S_2$ has just passed through the lever 16, and, the pair of feed rollers 9 are stopped after a predetermined count.

After the above-mentioned temporary stopping of the sheet $S_2$, when a sheet supply (print) start signal is emitted, the feed roller pair 9, print head 7 and ejector roller pair 12 are operated in the same manner as the cassette supply mode, and the guide plate 20 is returned to the lowered condition. Accordingly, the sheet $S_2$ manually supplied is subjected to the printing action in the print area 23 in the same manner as the cassette supply mode, and then is ejected onto the ejection tray 2.

By the way, in the above-mentioned printer, the upper and lower guides 10*a*, 10*b* of the convey guide 10 serves to direct the leading end of the sheet $S_1$ to the nip 13 of the feed roller pair 9 when the feed roller pair 9 feeds the sheet $S_1$ supplied from the upstream sheet supply cassette 1 toward the downstream side and to direct the sheet $S_2$ passed through the feed roller pair 9 between the sheet supply roller 11 and the uppermost sheet in the cassette 1 when the feed roller pair 9 feeds the sheet $S_2$ manually supplied from the downstream ejection tray 2 toward the upstream side.

However, as in the above-mentioned conventional case, when the upper and lower guides 10*a*, 10*b* of the convey guide 10 are secured to the printer frame 3 in the vicinity of the nip 13 of the feed roller pair 9, it is feared that the leading end of the manually supplied sheet $S_2$ is interfered with a free end of the upper guide 10*a* and/or a free end of the lower guide 19*b*, thus causing the poor feeding of the sheet. Particularly, it is true when the leading end of the sheet $S_2$ is curled.

Although this problem can be solved by separating the upper and lower guides 10*a*, 10*b* from the nip 13 of the feed roller pair 9, if do so, the upper and lower guides 10*a*, 10*b* cannot direct the leading end of the sheet $S_2$ to the nip 13 of the feed roller pair 9 correctly.

SUMMARY OF THE INVENTION

An object of the present invention is to provide a sheet feeding apparatus for an image forming system, which can correctly direct a leading end of a sheet to a nip of paired feed rollers when these feed rollers feed the sheet supplied from an upstream side toward a downstream side and can smoothly direct a sheet passed through the paired feed rollers when these feed rollers feed the sheet supplied from the downstream side toward the upstream side.

Another object of the present invention is to provide a recording system which does not need electro-magnetic clutches, plungers and control circuits for controlling them, and which is simple and inexpensive.

DETAILED DESCRIPTION OF THE PREFERRED EMBODIMENTS

An embodiment of the present invention will now be explained with reference to the accompanying drawings.

Figure 1:
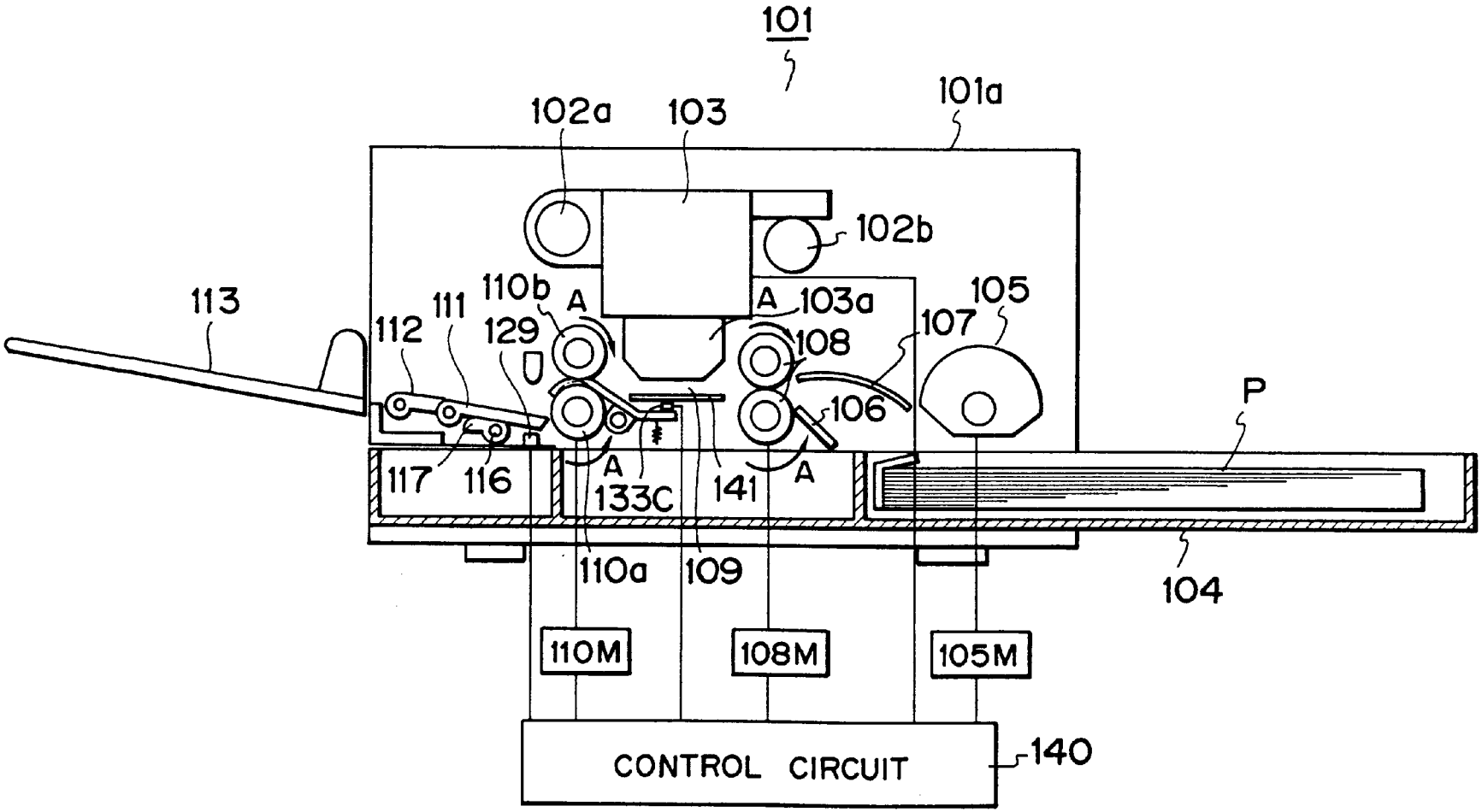
FIG. 1 is an elevational sectional view of an ink jet recording system into which a sheet feeding apparatus of the present invention is applied, in a sheet ejecting condition.

In FIG. 1, an ink jet recording system 101 is provided at its central upper portion with rails 102*a*, 102*b* extending perpendicular to a plane of FIG. 1. A print control portion 103 having a print head 103*a* is shifted for the scanning movement along the rails 102*a*, 102*b* to record an image on a sheet P which is intermittently fed. Incidentally, the sheet P is directed from a cassette 104 to a pair of feed rollers 108 via guide plates 106, 107 by means of a semicircular sheet supply roller 105. The feed rollers 108 intermittently feed the sheet by one line space toward a print area 109 below the print head 103. In this way, the sheet P is ejected onto an ejection tray 113 through guide plates 111, 112 by means of a pair of ejector rollers 110*a*, 110*b* while printing an image on the sheet.

Figure 3:
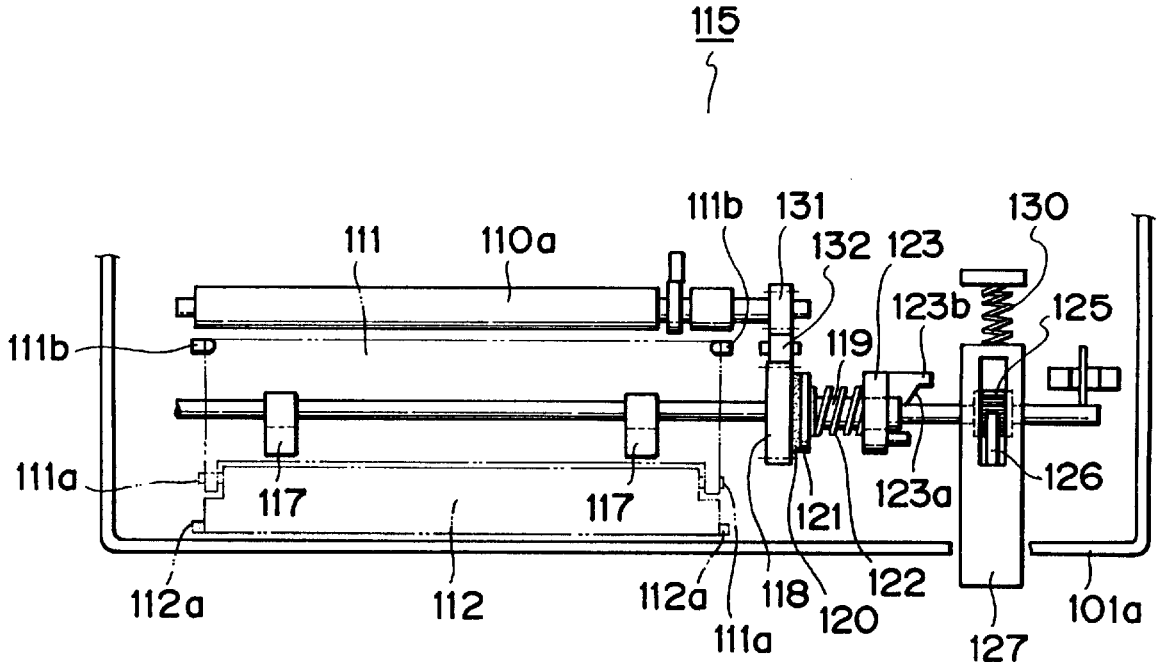
FIG. 3 is a sectional plan view of a biasing mechanism.

Next, a biasing mechanism 115 for the guide plate 111, which forms main part of the present invention, will be explained with reference to FIGS. 3 to 5.

A rotary shaft 116 is disposed in parallel with the ejector roller 110*a* and rotatable levers 117 for lifting the guide 111 are attached to the rotary shaft 116 horizontally (condition that the manual sheet supply is not performed). At the right (FIG. 3) and adjacent to a gear 118 rotatably mounted on the rotary shaft 116, a sleeve 119 is secured to the rotary shaft 116, which sleeve 119 incorporates a clutch pad 120 thereon. A clutch plate 121 is splined or keyed to the sleeve 119 near the clutch pad 120. A clutch spring 122 is disposed around the sleeve 119 and a pressure plate 123 is splined to the sleeve 119 near the spring 122. A substantially spiral cam 123*a* is attached to the pressure plate 123. A fixed member 124 contacting the profile of the cam 123*a* serves to shift the cam 123*a*. Incidentally, the reference numeral 123*b* denotes a stopper.

Further, a pinion 125 is secured to the right end portion of the rotary shaft 116, and a rack 126 meshed with the pinion 125 is slidably received in a longitudinal slot 127*a* formed in a manual supply button 127 telescopically moved with respect to a front wall of a frame 101*a* of the recording system. A flag 128 attached to the right end of the rotary shaft 116 blocks a photo-sensor 129 when the manual supply button 127 is depressed, thus detecting the manual supply mode. Incidentally, the reference numeral 130 denotes a return spring for the manual supply button 127. Further, a gear 131 secured to a shaft of the ejector roller 110*a* is drivingly connected to the gear 118 via an idler 132.

Incidentally, the guide plate 112 is rotatably mounted on the frame 10*a* via a shaft 112*a*, and the guide plate 111 is attached to the end of the guide plate 112 via a shaft 111*a*. The reference numeral 111*b* denotes a stopper for the free end of the guide plate 111. Further, a manual supply sensor lever 133 is supported by a shaft 133*a*. Incidentally, the reference numeral 133*b* denotes a spring for biasing an arcuate end portion of the sensor lever 133.

Next, the operation of the biasing mechanism 115 according to the present invention will be explained.

When the manual supply button 127 is depressed, the rack 126 is pushed, thus rotating the rotary shaft 116 via the gear 125. As a result, the levers 117 are shifted from a horizontal condition shown in FIG. 4 to a vertical condition shown in FIG. 5, and the guide plates 111, 112 are shifted from a condition shown in FIG. 1 to a condition shown in FIG. 2, that is to say, to a condition that the manually supplied sheet P from the tray 113 can be smoothly guided to a nip between the manual sheet supply rollers (ejector rollers) 110*a*, 110*b* by means of the guide plates 111, 112.

On the other hand, by the rotation of the rotary shaft 116, the pressure plate 123 and the cam 123*a* are rotated in a clockwise direction (FIG. 4) integrally. As a result, the pressure plate 123 compresses the clutch spring 122 from a length $L_1$ to a length $L_2$ via the cam 123*a* associated with the fixed member 124. Consequently, the clutch pad 120 is urged against the clutch gear 118 with a predetermined pressure, together forming a friction clutch.

Figure 4:
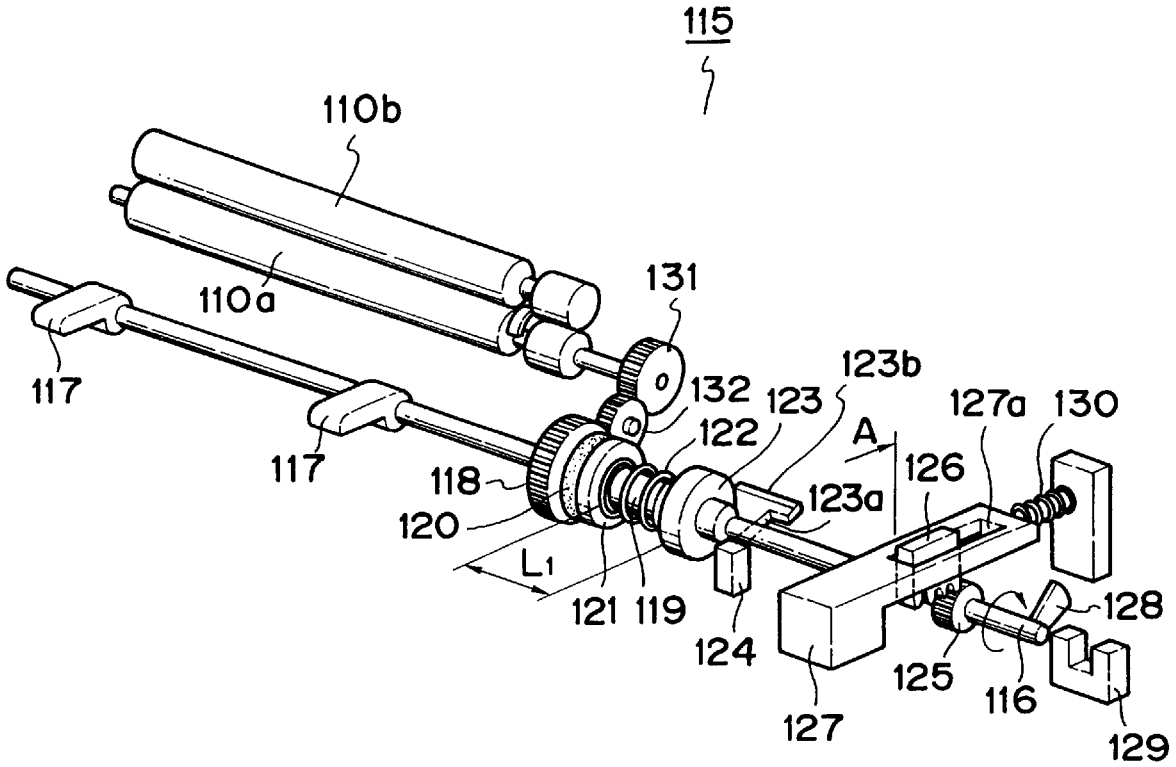
FIG. 4 is a perspective view of the biasing mechanism, in a sheet ejecting condition.
Figure 5:
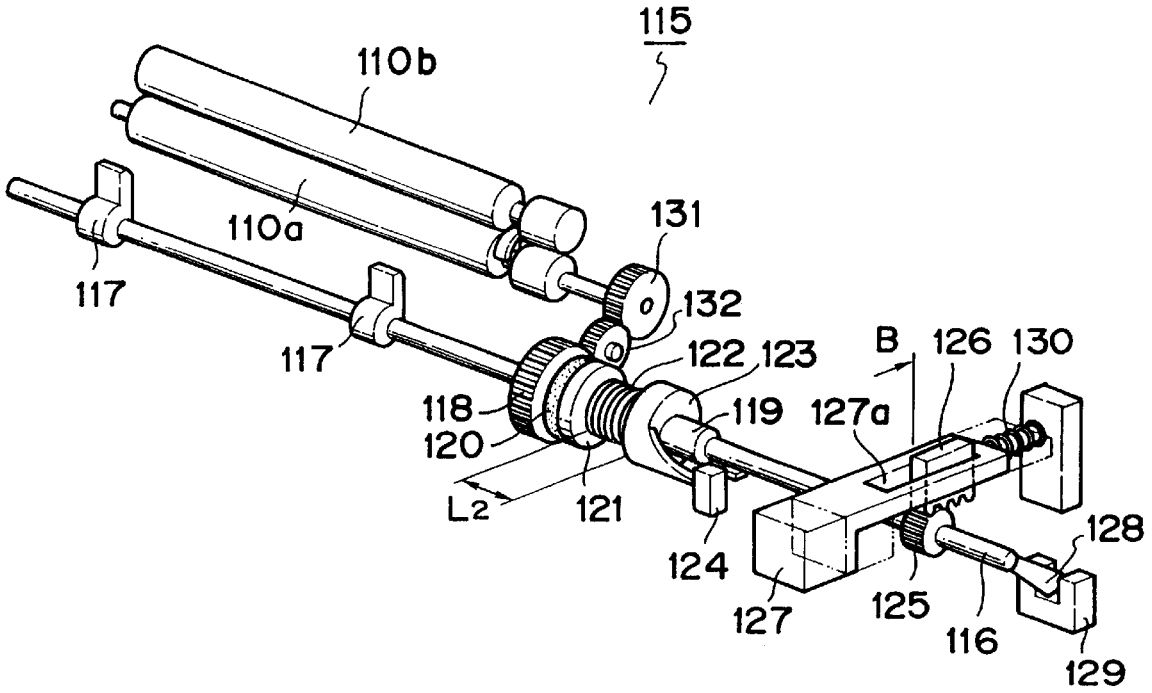
FIG. 5 is a perspective view of the biasing mechanism, in a manual sheet supply condition.

The predetermined pressure corresponds to a rotational force of the clutch gear 118 for restoring the condition shown in FIG. 4, and, in the illustrated embodiment, the force was selected to be 190 grams with respect to the clutch pad 120 having a diameter of 16 mm. This condition is a half-clutch condition. Thus, when the manual sheet supply roller (ejector roller) 110*a* is rotated in the clockwise direction for the manual sheet supply, the clutch pad 120 slips with respect to the gear 118 and is stopped by abutting the stopper 123*b* on the end of the cam 123*a* against the fixed member 124, with the result that the further rotation of the levers 117 does not damage the gears.

Then, when the manual sheet supply is finished and the ejector roller 110*a* is rotated in the anti-clockwise direction, the rotary shaft 116 is rotated in the anti-clockwise direction via the gears 131, 132, 118, pad 129 and clutch plate 121, with the result that the levers 117 return to the horizontal condition as shown in FIGS. 1 and 4 and the cam 123*a* returns its non-loaded condition. In this way, the guide plates 11, 112 are lowered, thus permitting the smooth ejection of the sheet P.

At the same time, since the flag 128 also returns to the condition shown in FIG. 4, the manual supply mode is released. Also, the rack 126 returns to its initial position. Further, during the printing operation, even if the manual supply button 127 is depressed to urge the clutch plate 121 against the gear 118, since the clutch pad 120 can slip on the gear 118, the printing operation does not badly affected.

In addition, since the guide plate is divided into two guide plates 111, 112 and the guide plate 112 disposed near the manual sheet supply rollers 110*a*, 110*b* is horizontally arranged in confronting relation to the nip between these rollers 110*a*, 110*b*, the leading end of the manually supplied sheet P does not slip down far away from the nip due to the provision of the guide plate 111, thus permitting the smooth manual sheet supply.

Incidentally, in this embodiment, while the guide plate 111 was arranged horizontally, the guide plate may be sloped downwardly toward the nip so that the manual sheet supplying operation can be improved. Further, in this embodiment, while the ink jet recording system was explained, the recording means is not limited to the ink jet recording means.

Explaining a control system, in FIG. 1, a control circuit 140 is connected to the print control portion 103 and is also connected to drive motors 105M, 108M and 110M for driving the sheet supply roller 105, feed roller pair 108 and ejector roller pair 110, respectively. Further, the control circuit 140 is connected to a photo-sensor 133C for detecting the movement of the sensor lever 133 and emitting a signal and is also connected to the photo-sensor 129.

Next, the control is explained. While the photo-sensor 129 is not detecting the flag 128, i.e., during the cassette supply mode, when the control circuit 140 emits the sheet supply signal on the basis of a data signal from a host computer (not shown), the sheet supply roller 105 is rotated in the clockwise direction to supply the sheet from the cassette 104. The leading end of the sheet is guided by the guide plates 106, 107, and then is stopped when it is abutted against the nip between the feed rollers 108 which are now stopped. Then, a loop is formed in the sheet between the feed roller pair 108 and the sheet supply roller 105, thus correcting the skew-feed of the sheet.

Then, the paired feed rollers 108 are rotated in directions shown by the arrows A to convey the sheet until the leading end of the sheet reaches a predetermined position on a platen 141. Now, the feed rollers are stopped. Then, the printing of a predetermined length is performed by the print head 103*a*, and then, the sheet is line spaced by a predetermined amount by means of paired feed rollers 108 rotated in the directions A, and the paired ejector rollers 110. Thereafter, the printing is repeated by means of the print head 103*a*. After the printings and the line spaces are repeated up to the last printing line on the sheet, the sheet is ejected on the ejection tray 113 by the paired ejector rollers 110.

Next, the control for the manual supply mode will be explained.

Figure 2:
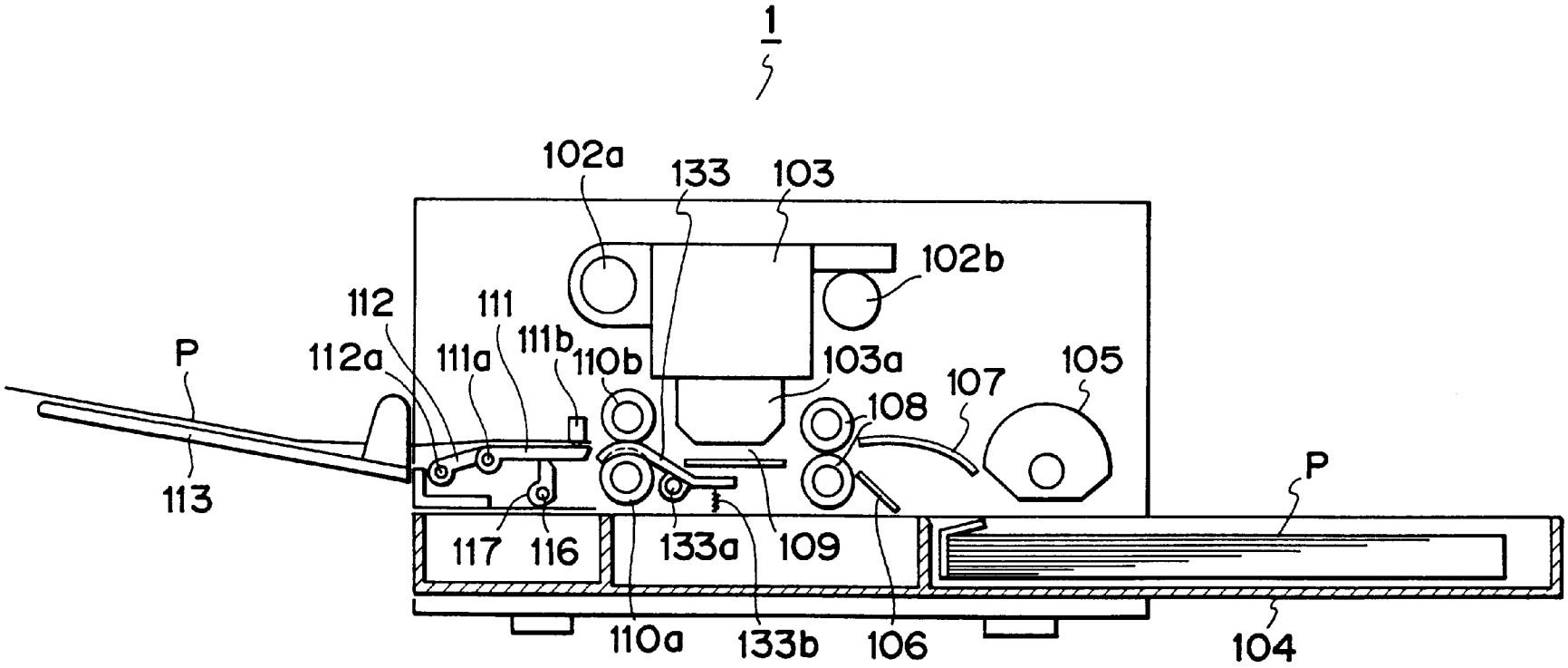
FIG. 2 is an elevational sectional view of the recording system of FIG. 1, in a manual sheet supply condition.

When the manual supply button 127 is depressed, as mentioned above, the guides 111, 112 are shifted to the position shown in FIG. 2, and the flag 128 blocks the photo-sensor 129 to turn it OFF. The control circuit 140 judges that the manual supply mode is selected, on the basis of the OFF signal form the photo-sensor 129.

As shown in FIG. 2, the sheet P is inserted along the ejection tray 113 and the guide plates 111, 112. When the leading end of the sheet abuts against the nip between the ejector rollers 110*a*, 110*b*, the leading end rocks the sensor lever 133, with the result that the sheet detection signal is emitted from the sensor 133C. When the control circuit 140 receives the sheet detection signal, it rotates the paired ejector rollers 110 and the paired feed rollers 108 in directions opposite to those in the cassette supply mode, thus feeding the sheet to the feed roller pair 108. After the sheet is pinched by the paired feed rollers 108, the latter continues to feed the sheet so that the sheet is overlapped with the sheet stack housed in the cassette 104. After the end (near the ejection tray) of the sheet P has passed through the print area 109, the paired feed rollers 108 are stopped. The timing of the stop of the rollers is so selected that, after a predetermined time has been elapsed (which can be determined by a timer or counter) from the time when the ejector rollers 110 start to feed the sheet reversely, the paired feed rollers 108 and the paired ejector rollers 110 are stopped. At this point, the sheet P is pinched by the feed rollers 108.

Then, in response to the sheet supply signal, the paired feed rollers 108 are rotated in the directions same as those in the cassette supply mode, until the leading end of the sheet P reaches the predetermined position on the platen 141. Now, the feed rollers are stopped. Thereafter, similar to the cassette supply mode, the sheet P is line spaced by a predetermined amount by means of the rollers 108, 110 whenever the printing of predetermined length is effected. After the printing operation, the sheet P is ejected onto the ejection tray by the paired ejector rollers 110. Since the guide plates 111, 112 has already been lowered to the position shown in FIG. 1 due to the rotation of the levers 117 after the end (near the ejection tray) of the sheet P has passed through the nip between the ejector rollers 110, the leading end of the sheet does not interfere with the free end of the guide plate 111.

Figure 6:
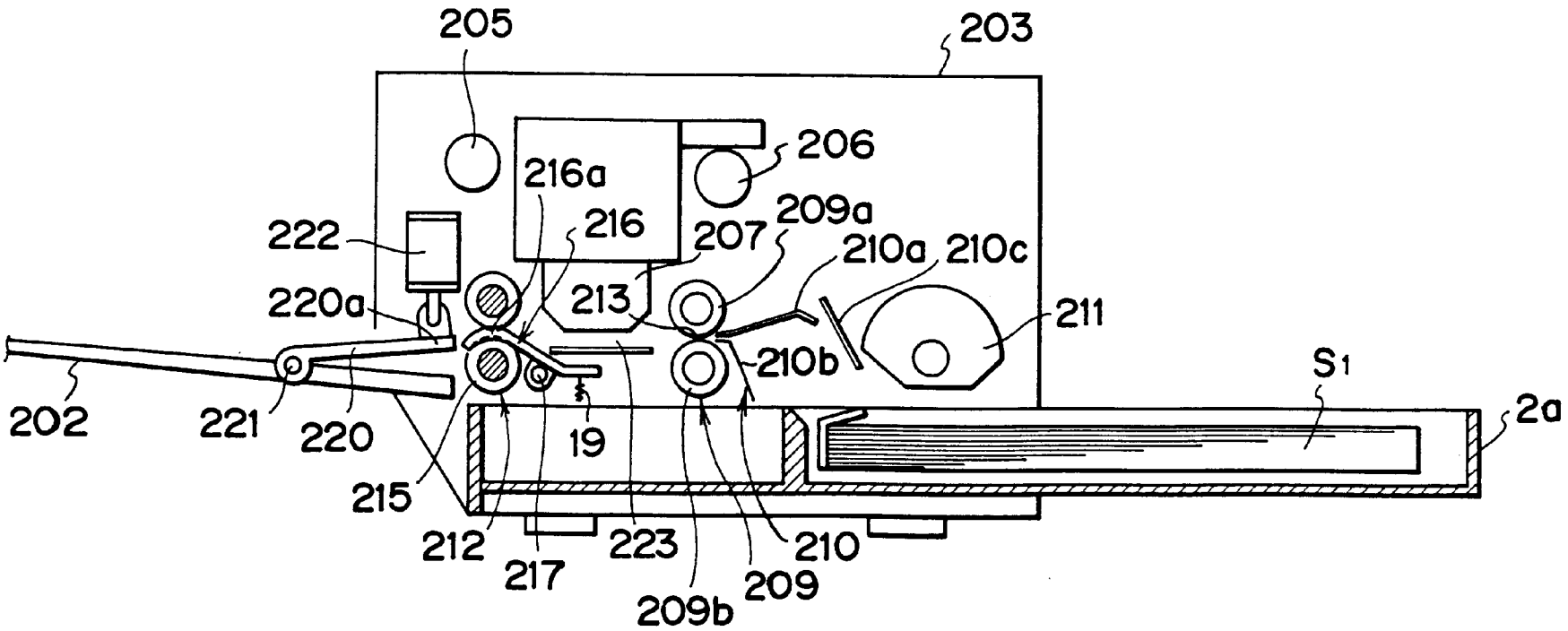
FIG. 6 is an elevational sectional view of an image forming system (printer) incorporating a sheet feeding apparatus according to a second embodiment of the present invention.
Figure 7:
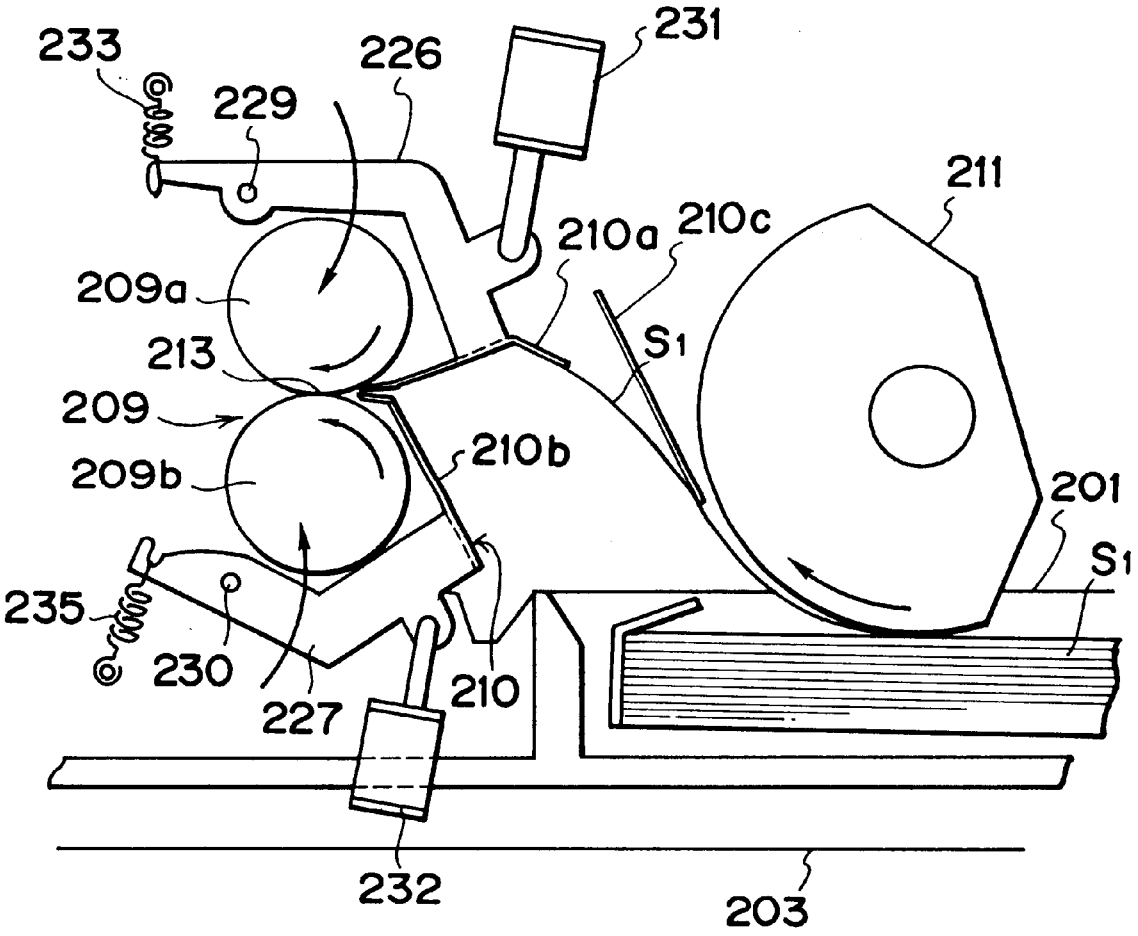
FIGS. 7 and 8 are elevational sectional views of the sheet feeding apparatus of FIG. 6.
Figure 8:
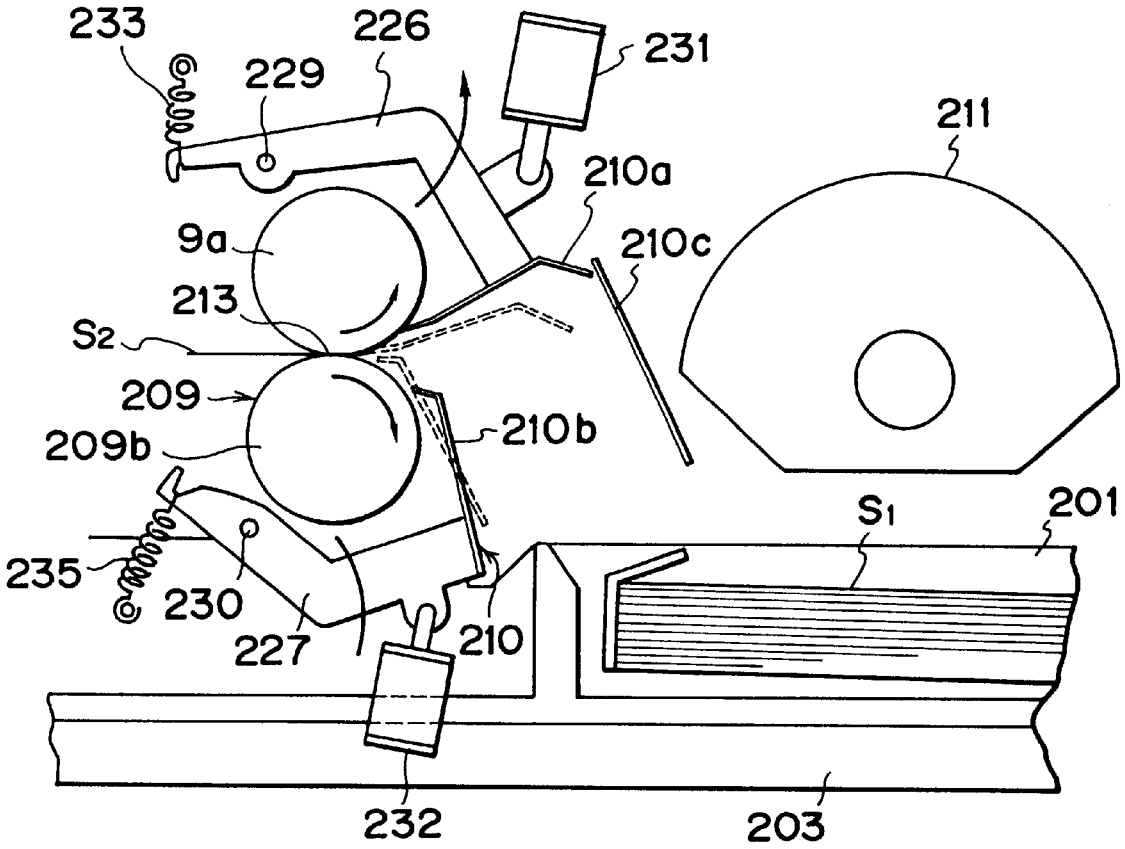

FIG. 6 shows the whole construction of an image forming system (printer) incorporating a sheet feeding apparatus according to a second embodiment of the present invention, and FIGS. 7 and 8 show the sheet feeding apparatus.

A convey guide 210 comprises upper and lower guides 210*a* which are shiftably mounted on a printer frame 203, and an auxiliary guide 210*c* secured to the printer frame 203. The upper and lower guides 210*a*, 210*b* have rocker arms 226, 227 integrally formed therewith, respectively. These guides are mounted on the printer frame 203 for pivotal movement in the up-and-down direction, via the rocker arms 226, 227. The rocker arms 226, 227 are rotatably mounted on shafts 229, 230 fixed to the printer frame 203 and are pivotable around the shafts 229, 230.

Plungers 231, 232 secured to the printer frame 203 are connected to front ends of the rocker arms 226, 227, respectively. Further, coil springs 233, 235 connect rear ends of the rocker arms 226, 227 to the printer frame 203, respectively, which coil springs 233, 235 bias the respective rocker arms 226, 227 to extend the respective plungers 231, 232.

FIG. 7 shows a case where a sheet $S_1$ is supplied from an upstream sheet supply cassette 201. In this condition, the plungers 231, 232 are in OFF conditions. Accordingly, the rocker arms 226, 227 are pivoted around the shafts 229, 230 by the biasing forces of the coil springs 233, 235 until the respective plungers 231, 232 are extended at the maximum extent. At that position, the arms are stopped. Incidentally, the rocker arms 226, 227 are rotated around the respective shafts 229, 230 in directions shown by the arrows. In this case, the upper guide 210*a* and the lower guide 210*b* are positioned in the proximity of the nip 213 of the feed roller pair 209, as shown. Thus, the sheet $S_1$ supplied from the sheet supply cassette 201 is guided by the upper guide 210*a*, lower guide 210*b* and auxiliary guide 210*c* so that the leading end of the sheet is directed to the nip 213 of the feed roller pair 209 correctly.

FIG. 8 shows a case where a sheet $S_2$ is manually supplied from a upstream ejection tray 202. In this condition, the plungers 231, 232 are in ON (energized) conditions. Accordingly, the rocker arms 226, 227 are pulled by the respective plungers 231, 232 so that the rocker arms are pivoted around the shafts 229, 230 in opposition to the coil springs 233, 235 until the plungers are extracted at the minimum extent. Incidentally, the rocker arms 226, 227 are rotated around the respective shafts 229, 230 in directions shown by the arrows. In this case, the upper guide 210*a* and the lower guide 210*b* are shifted from positions shown by the phantom line to positions shown by the solid line to be spaced away from the nip between the paired feed rollers 209. Thus, after the sheet $S_2$ manually supplied from the ejection tray 202 has passed through the paired feed rollers 209, it does not interfere with the upper and lower guides 210*a*, 210*b* and is smoothly guided by the upper guide 210*a*, lower guide 210*b* and auxiliary guide 210*c* to be positioned between the sheet supply roller 211 and the uppermost sheet in the sheet supply cassette 201. In this case, even if the leading end of the sheet $S_2$ is curled upwardly as shown or downwardly, it does not interfere with the upper and lower guides 210*a*, 210*b*.

Incidentally, the plungers 231, 232 are turned ON when the manual supply mode switch is turned ON, and are turned OFF when the sheet supply (print) start signal is outputted.

Next, a third embodiment of the present invention will be explained.

Figure 9:
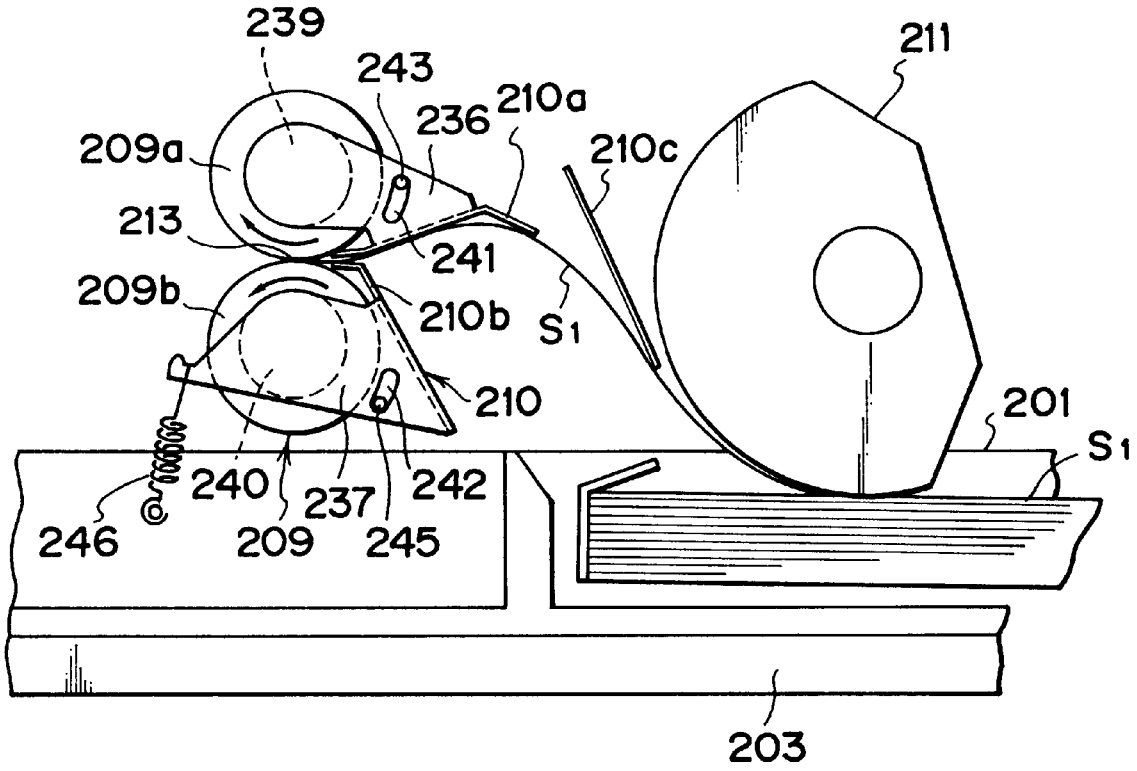
FIGS. 9 and 10 are elevational sectional views of a sheet feeding apparatus according to a third embodiment of the present invention.
Figure 11:
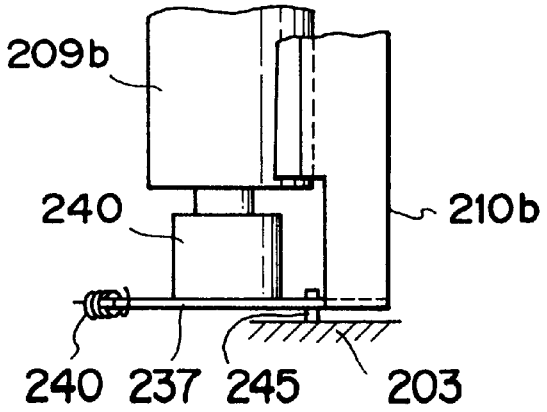
FIG. 11 is a partial plan view for showing upper and lower guides for a pair of feed rollers in the sheet feeding apparatus of FIGS. 9 and 10.
Figure 10:
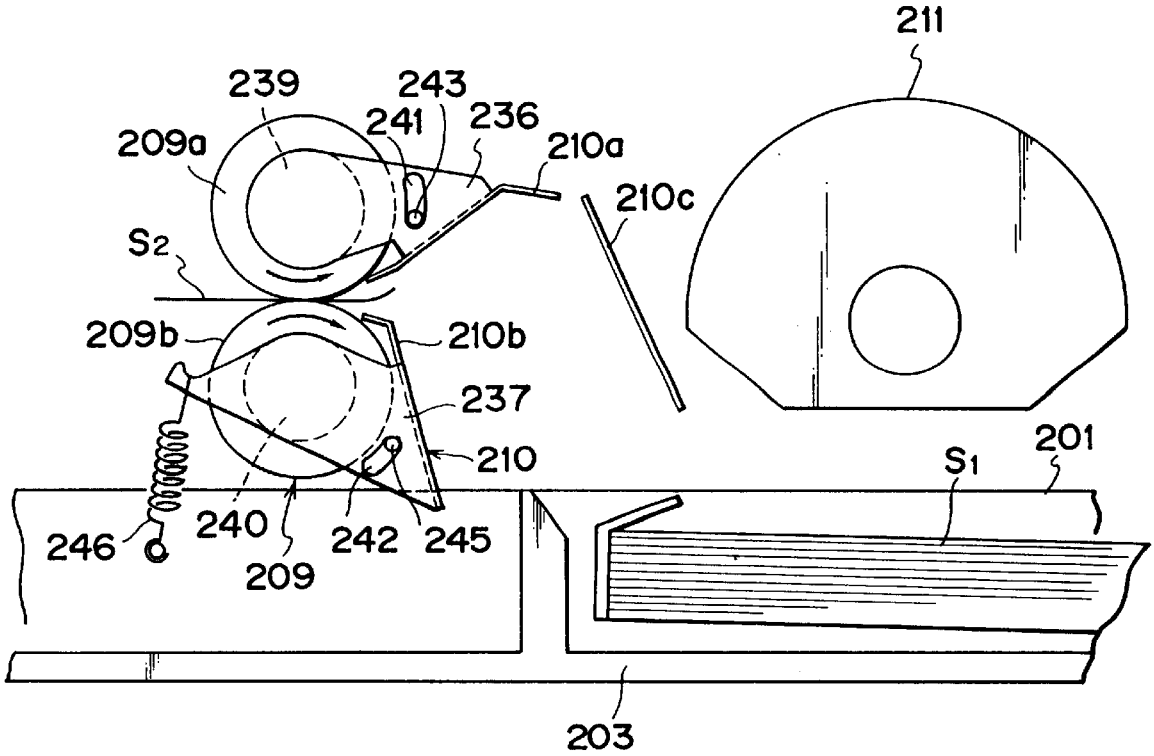

FIGS. 9 to 11 show a sheet feeding apparatus according to a third embodiment of the present invention.

Upper and lower guides 210*a*, 210*b* have brackets 236, 237 integrally formed therewith, respectively, and are rotatably mounted on roller shafts of upper and lower rollers 209*a*, 209*b* of a feed roller pair 209 via friction clutches 239, 240 attached to the brackets 236, 237, respectively. The brackets 236, 237 have arcuated slots 241, 242 formed therein, respectively, the arcs having their centers corresponding to centers of the friction clutches 239, 240. The slots 241, 242 receive guide pins 243, 245 secured to a printer frame 203, respectively (see FIG. 11).

FIG. 9 shows a case where a sheet $S_1$ is supplied from an upstream sheet supply cassette 201. In this condition, the upper roller 209*a* of the feed roller pair 209 is rotated in a clockwise direction as shown by the arrow, and the lower roller 209*b* is rotated in an anti-clockwise direction as shown by the arrow. Accordingly, the bracket 236 of the upper guide 210*a* is rotated in a clockwise direction around the friction clutch 239 which is now in an OFF condition, until it is regulated by the guide pin 243. On the other hand, the bracket 237 of the lower guide 210*b* is rotated in an anti-clockwise direction around the friction clutch 240 which is now in an OFF condition, until it is regulated by the guide pin 245. In this case, the bracket 236 of the upper guide 210*a* is rotated at its own weight, and the bracket 237 of the lower guide 210*b* is rotated by the biasing force of a coil spring 246. As a result, the upper and lower guides 210*a*, 210*b* will approach the nit of the feed roller pair 209 so that they can correctly direct the leading end of the sheet $S_1$ to the nip of the feed roller pair 209.

FIG. 10 shows a case where a sheet $S_2$ is manually supplied from a upstream ejection tray 202. In this condition, the upper roller 209*a* of the feed roller pair 209 is rotated in an anti-clockwise direction as shown by the arrow, and the lower roller 209*b* is rotated in a clockwise direction as shown by the arrow. Accordingly, the bracket 236 of the upper guide 210*a* is rotated in an anti-clockwise direction by a rotational force of the upper roller 209*a* transmitted via the friction clutch 239 which is now in an ON condition, until it is regulated by the guide pin 243. On the other hand, the bracket 237 of the lower guide 210*b* is rotated in a clockwise direction in opposition to the biasing force of the coil spring 246 by a rotational force of the lower roller 209*b* transmitted via the friction clutch 240 which is now in an ON condition, until it is regulated by the guide pin 245. As a result, the upper and lower guides 210*a*, 210*b* will be separated from the nip of the feed roller pair 209 so that they can correctly direct the leading end of the sheet $S_2$ passed through the feed roller pair 209 to the nip 213 of the feed roller pair 209, without the interference between the leading end and the guides 210*a*, 210*b*.

In this embodiment, when the paired feed rollers 209 feed the sheet $S_1$ supplied from the downstream side toward the upstream side, the upper and lower guides 210*a*, 210*b* will approach the nip 213 of the feed roller pair 209 in synchronous with the rotational movements of the upper and lower rollers 209*a*, 209*b* of the feed roller pair 209. On the other hand, when the paired feed rollers 209 feed the sheet $S_2$ supplied from the upstream side toward the upstream side, the upper and lower guides 210*a*, 210*b* will be separated from the nip 213 of the feed roller pair 209 in synchronous with the rotational movements of the upper and lower rollers 209*a*, 209*b* of the feed roller pair 209. Thus, it is not required to provide any actuator (solenoid and the like) for shifting the upper and lower guides 210*a*, 210*b* and to control the shifting of such guides.

Incidentally, in the above second and third embodiments, while both the upper and lower guides 210*a* and 210*b* were shifted, either the upper guide 210*a* or the lower guide 210*b* may be shifted in consideration of the space savings. In this case, for example, when the sheets having the curls other than the specific curl are not used as the sheet to be manually supplied, the object of the invention can be achieved adequately.

Next, the ink jet print head 103*a*, 207 used with the first, second and third embodiments will be explained.

Preferably, a principle for flying ink droplet in a bubble jet recording system can be realized by using the fundamental principles, for example, as disclosed in U.S. Pat. Nos. 4,723,129 and 4,740,796. Although this system can be applied to both a so-called "on-demand type" and "continuous type", it is more effective when the present invention is particularly applied to the on-demand type, because, by applying at least one drive signal corresponding to the record information and capable of providing the abrupt temperature increase exceeding the nucleate boiling to the electrical/thermal converting elements arranged in correspondence to the sheet or liquid passages including the liquid (ink) therein, it is possible to form a bubble in the liquid (ink) in corresponding to the drive signal by generating the film boiling on the heat acting surface of the recording head due to the generation of the thermal energy in the electrical/thermal converting elements. Due to the growth and contraction of the bubble, the liquid (ink) is discharged from the discharge opening to form at least one ink droplet. When the drive signal has a pulse shape, since the growth and contraction of the bubble can be quickly effected, more excellent ink discharge is achieved.

Now, the principle for forming the flying droplet in the bubble jet recording system will be explained with reference to FIGS. 12A to 12G.

Figure 12A:
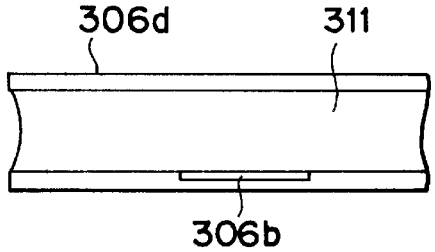
FIGS. 12A to 12G are views for explaining a bubble jet discharging principle.
Figure 12B:
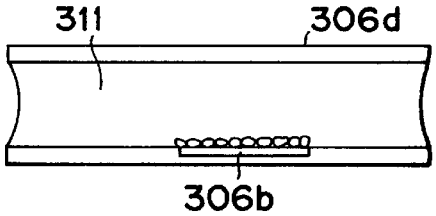
Figure 12C:
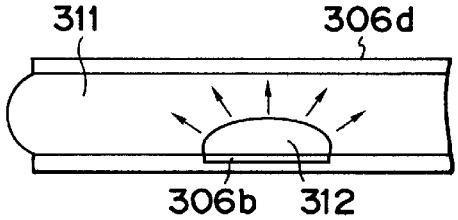

In the steady-state, as shown in FIG. 12A, a tension force of ink 311 filled in a nozzle 306*d* is equilibrated with the external force at an discharge opening surface. In this condition, when the ink 311 is desired to fly, an electrical/thermal converter 306*b* disposed in the nozzle 306*d* is energized to abruptly increase the temperature of the ink in the nozzle 306*d* exceeding the nucleate boiling. Consequently, as shown in FIG. 12B, the ink portion adjacent to the electrical/thermal converter 306*b* is heated to create a fine bubble, and then the heated ink portion is vaporized to generate the film boiling, thus growing the bubble 312 quickly, as shown in FIG. 12C.

Figure 12D:
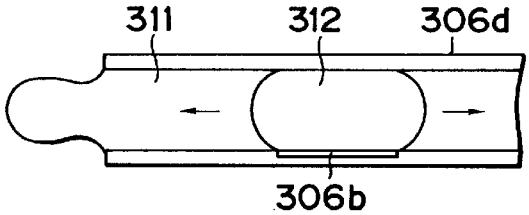
Figure 12E:
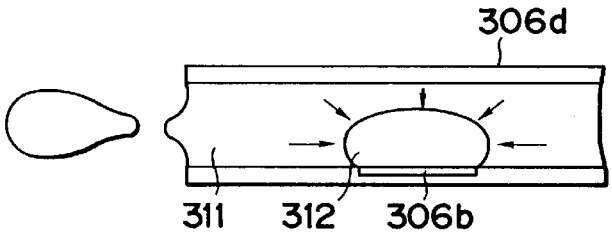
Figure 12F:
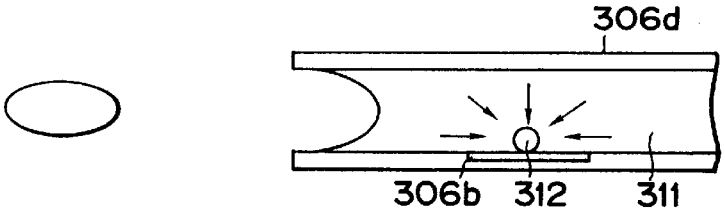
Figure 12G:
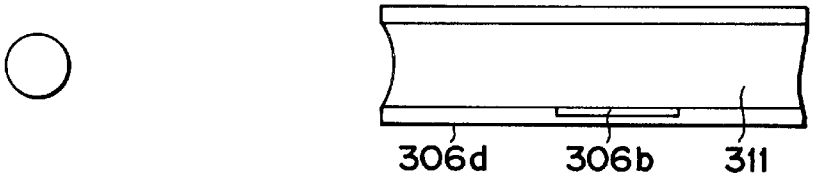
Figure 13:
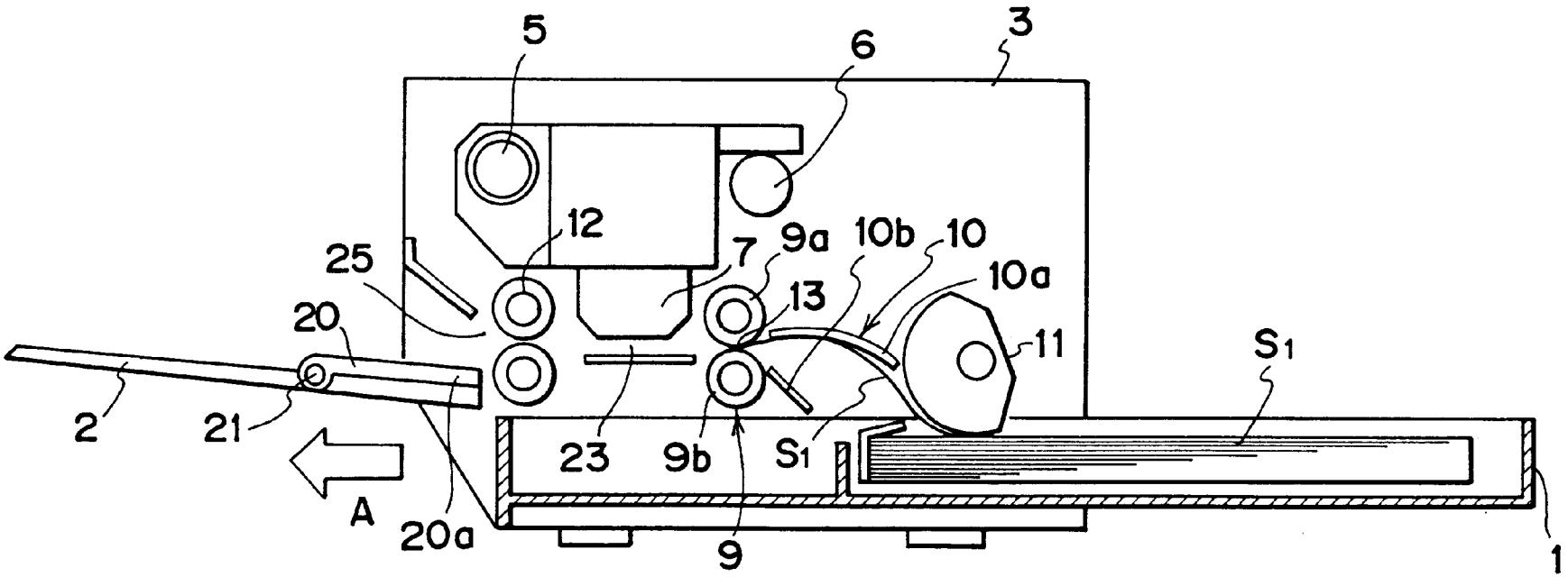
FIGS. 13 to 15 are elevational sectional views of a conventional printer as an image forming system.
Figure 14:
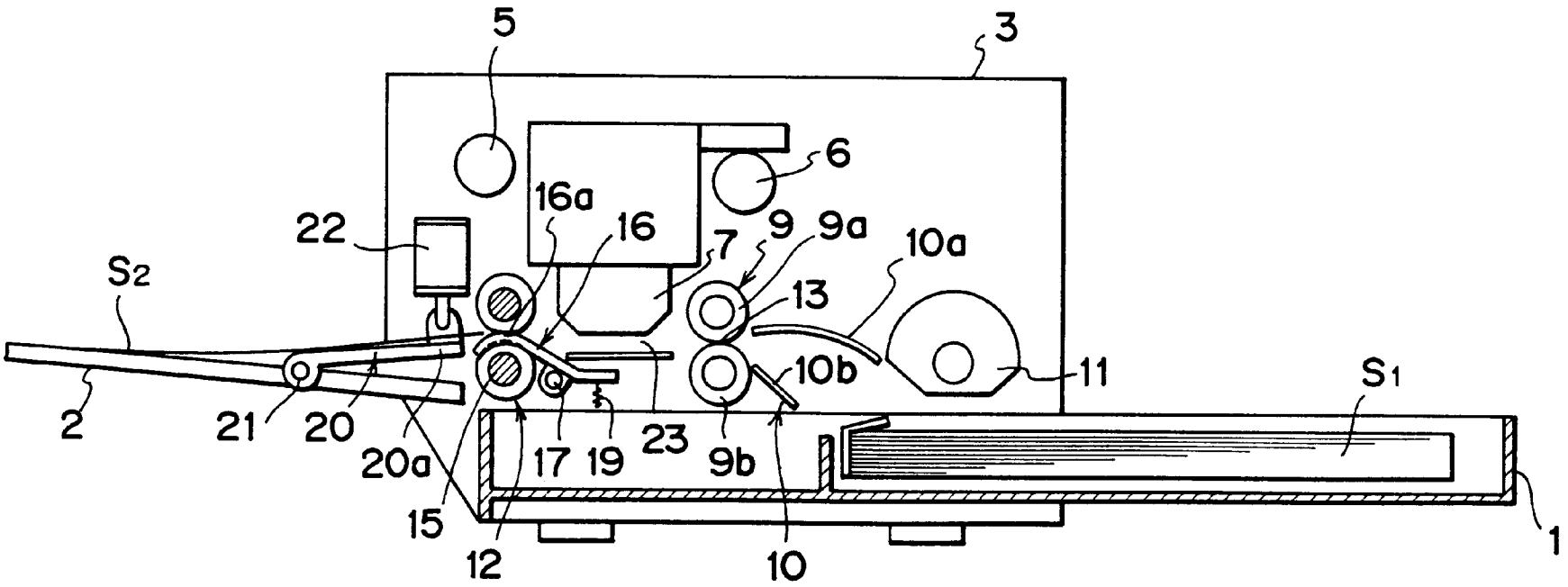
Figure 15:
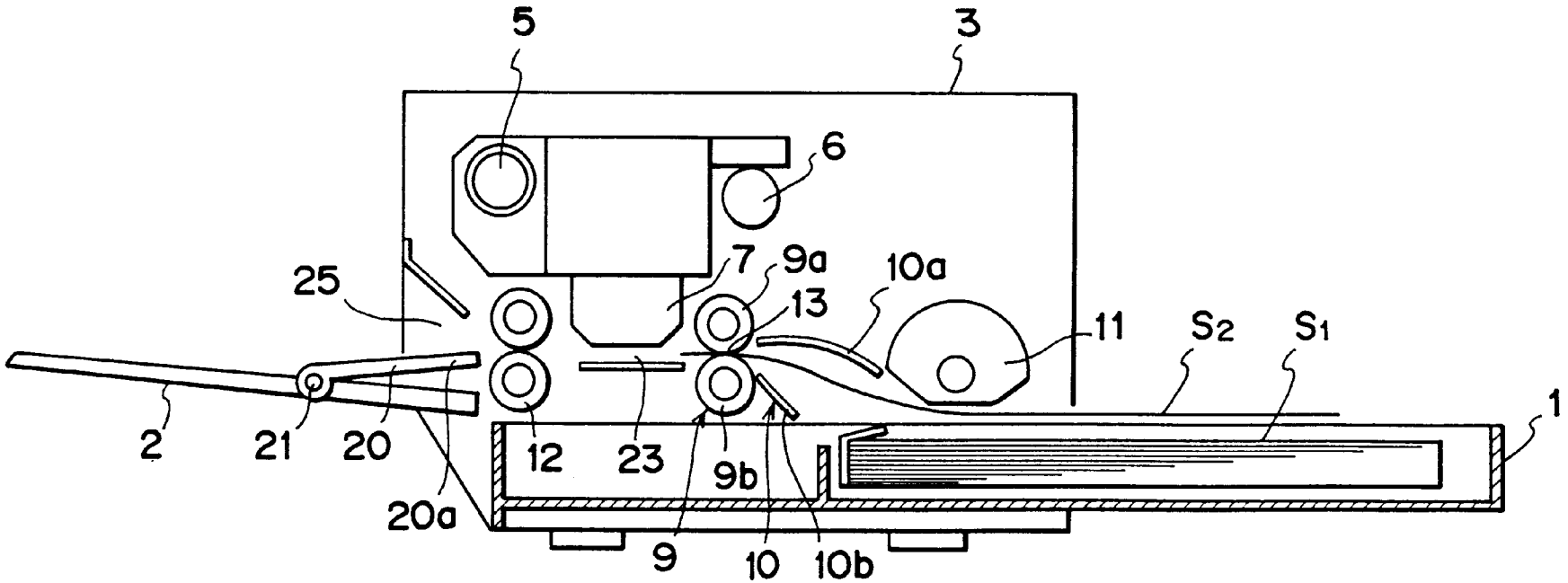

When the bubble 312 is grown at the maximum extent as shown in FIG. 12D, the ink droplet is pushed out of the discharge opening of the nozzle 306*d*. When the electrical/thermal converter 306*b* is disenergized, as shown in FIG. 12E, the grown bubble 312 is cooled by the ink 311 in the nozzle 306*d* to contract. Thus, due to the growth and contraction of the bubble, the ink droplet is discharged to fly. Further, as shown in FIG. 12F, when the ink is quickly cooled by contacting the surface of the electrical/thermal converter 306*b*, the volume of the bubble 312 is diminished or reduced to a negligible extent. When the bubble 312 is diminished, as shown in FIG. 12G, the ink is supplied from a common liquid chamber 306*g* into the nozzle 306*d* by a capillary phenomenon, thus preparing for the next ink discharge.

Accordingly, by shifting a carriage and by selectively energizing the electrical/thermal converters 306*b* in response to the pulse drive signal in synchronous with the carriage movement, it is possible to record the ink image on the sheet.

Such pulse drive signal may be ones disclosed in U.S. Pat. Nos. 4,463,359 and 4,345,262. Incidentally, by adopting the condition disclosed in U.S. Pat. No. 4,313,124 providing the invention regarding the temperature increasing rate on the heat acting surface, a further excellent recording can be performed.

What is claimed is:

1. A sheet feeding apparatus comprising:

feeding means including a pair of rollers forming a nip, therebetween, each of said pair of rollers being rotatable in both directions for selectively pinching and feeding a sheet in a first direction and a second direction opposite the first direction;

a tray disposed downstream of said feeding means in the second direction to stack the sheet fed in the second direction by said feeding means;

guide means for guiding the sheet, said guide means being disposed between said feeding means and said tray and being shiftable between a first position near the nip to direct the sheet from said tray toward the nip thereby to feed the sheet in the first direction by said feeding means, and a second position further away from the nip than said first position to permit advance of the sheet fed by said feeding means in the second direction to said tray;

shifting means for selectively shifting said guide means between said first position and said second position, said shifting means including manually operated means for being moved by manual operation and converting means for mechanically converting a movement of said manually operated means to a shift of said guide means from the second position to the first position; and drive transmission means for driving said shifting means, said drive transmission means including a frictional clutch including a pair of clutch members engageable with each other with a pressure for transmitting a drive force from a drive source to said shifting means, the pressure between said pair of clutch members decreasing when said shifting means shifts said guide means to the second position, wherein when the guide means is shifted to the first position, and a sheet is manually set on said tray and guided to the nip by said guide means, the sheet is fed in the first direction by said feeding means.

2. A sheet feeding apparatus according to claim 1, wherein said guide means comprises a guide plate for guiding a lower surface of the sheet.

3. A sheet feeding apparatus according to claim 2, wherein said guide plate is pivotally supported.

4. A sheet feeding apparatus according to claim 1, wherein said drive transmission means also drives said feeding means and said friction clutch transmits a driving force of said feeding means.

5. A sheet feeding apparatus according to claim 1, wherein said shifting means comprises a rotatable lever which is rotated by a manual operation to shift said guide means from said second position to said first position.

6. A recording system comprising:

feeding means including a pair of rollers forming a nip therebetween, each of said pair of rollers being rotatable in both directions, for selectively nipping and feeding a sheet in a first direction and a second direction opposite the first direction;

a tray disposed downstream of said feeding means in the second direction to stack the sheet fed in the second direction by said feeding means;

guide means for guiding the sheet, said guide means being disposed between said feeding means and said tray and being shiftable between a first position near said nip to direct the sheet from said tray toward the nip thereby to feed the sheet in the first direction by said feeding means, and a second position further away from said nip than said first position to permit advance of the sheet fed by said feeding means in the second direction to said tray;

shifting means for selectively shifting said guide means between said first position and said second position, said shifting means including manually operated means for being moved by manual operation and converting means for mechanically converting a movement of said manually operated means to a shift of said guide means from the second position to the first position;

drive transmission means for driving said shifting means, said drive transmission means including a frictional clutch including a pair of clutch members engageable with each other with a pressure for transmitting a drive force from a drive source to said shifting means, the pressure between said pair of clutch members decreasing when said shifting means shifts said guide means to the second position; and recording means for recording an image on a sheet fed by said first feeding means, wherein when the guide means is shifted to the first position, and a sheet is manually set on said tray and guided to the nip by said guide means, the sheet is fed in the first direction by said feeding means.

7. A recording system according to claim 6, wherein said recording means is disposed at a downstream side in a first direction of said feeding means.

8. A recording system according to claim 7, further including a second feeding means disposed at a downstream side of said recording means for feeding the sheet on which the image was formed by said recording means toward the downstream side.

9. A recording system according to claim 8, further comprising second guide means disposed at a downstream side of said second feeding means for guiding the sheet from the downstream side to said second feeding means; and wherein said control means further controls said second feeding means so that the guided sheet is fed toward the downstream side by said second feeding means and then is fed back toward the upstream side by said second feeding means.

10. A recording system according to claim 9, wherein said control means controls said first feeding means to feed the sheet guided by said first guide means and fed to said recording means by said second feeding means toward the upstream side.

11. A recording system according to claim 10, wherein said control means controls said second feeding means and said recording means to feed a sheet fed toward the downstream side by said first feeding means to said recording means by feeding said sheet toward the upstream side, and then to record the image on said sheet by said recording means.

12. A recording system according to claim 6, wherein said recording means comprises an ink jet head for discharging ink.

13. A recording system according to claim 12, wherein said ink jet head includes means for discharging the ink by thermal energy.

14. A recording system comprising:

feeding means including a pair of rollers forming a nip therebetween for pinching a sheet, each of said pair of rollers being rotatable in both directions for selectively feeding the sheet in a first direction and a second direction opposite to the first direction;

guide means for guiding the sheet, said guide means being shiftable between a first position near the nip to direct the sheet toward the nip thereby to feed the sheet in the first direction by said feeding means, and a second position further away from the nip than said first position to permit advance of the sheet fed by said feeding means in the second direction;

recording means for recording an image on the sheet fed by said feeding means; and shifting means for selectively shifting said guide means between said first position and said second position, said shifting means including manually operated means for being moved by manual operation and converting means for mechanically converting a movement of said manually operated means to a shift of said guide means from the second position to the first position.

15. A recording system according to claim 14, wherein said recording means is disposed at a downstream side in the first direction of said feeding means.

16. A recording system according to claim 15, further including second feeding means disposed at a downstream side of said recording means for feeding the sheet toward the downstream side.

17. A recording system according to claim 16, further including a control means for controlling said first feeding means, second feeding means and recording means, wherein when the guide means is shifted to the first position, a sheet manually set on said tray is guided to the nip by said guide means, said control means controls said first feeding means, second feeding means and recording means such that the sheet is fed in the first direction through said recording means, then the sheet is fed in the second direction until the sheet passes through said first feeding means by said first feeding means and said second feeding means, while an image is recorded on the sheet by said recording means.

18. A recording system according to claim 14, wherein said recording means comprises an ink jet head for discharging ink.

19. A recording system according to claim 18, wherein said ink jet head includes means for discharging the ink by thermal energy.

20. A sheet feeding apparatus, comprising:

feeding means including a pair of rollers forming a nip therebetween, each of said pair of rollers being rotatable in both directions for selectively nipping and feeding a sheet in a first direction and a second direction opposite the first direction;

a tray disposed downstream of said feeding means in the second direction to stack the sheet fed in the second direction by said feeding means;

guide means for guiding the sheet, said guide means being disposed between said feeding means and said tray, said guide means including;

a first guide member shiftable between a first position near to direct the sheet from the tray toward the nip thereby to feed the sheet in the first direction by said feeding means, and a second position further away from the nip than the first position to permit advance of the sheet fed by said feeding means in the second direction to the tray;

shifting means for selectively shifting said first guide member between the first position and the second position, said shifting means including manually operated means for being moved by manual operation and converting means for mechanically converting a movement of said manually operated means to shift said first guide member from the second position to the first position;

a second guide member for guiding the sheet;

a third guide member having one side end connected to said second guide member and another end connected to said first guide member, said third guide member being shiftable in accordance with a shift of said first guide member; and drive transmission means for driving said shifting means, said drive transmission means including a frictional clutch including a pair of clutch members engageable with each other with a pressure for transmitting a drive force from a drive source to said shifting means, the pressure between said pair of clutch members decreasing when said shifting means shifts said guide means to the second position.

21. A sheet feeding apparatus according to claim 20, wherein said first guide member guides an under surface of the sheet.

22. A sheet feeding apparatus according to claim 20, further comprising drive transmission means for transmitting a drive force to shift said first guide means, wherein said drive transmission means including a frictional clutch.

23. A sheet feeding apparatus according to claim 22, wherein said drive transmission means drives said shifting means to shift said first guide means from the first position to the second position with a drive force, said drive transmission means also transmitting the drive force to said feeding means for feeding the sheet from the downstream side toward the upstream side.

24. A recording system comprising:

feeding means including a pair of rollers forming a nip therebetween, each of said pair of rollers being rotatable in both directions for selectively pinching and feeding a sheet in a first direction and a second direction opposite to the first direction;

a tray disposed downstream of said feeding means in the second direction to stack the sheet fed in the second direction by said feeding means;

guide means for guiding the sheet, said guide means being disposed between said feeding means and said tray and being shiftable between a first position near the nip to direct the sheet from said tray toward the nip thereby to feed the sheet in the first direction by said feeding means, and a second position further away from the nip than said first position to permit advance of the sheet fed by said feeding means in the second direction to said tray;

shifting means for selectively shifting said guide means between said first position and the second position, said shifting means including manually operated means for being moved by manual operation and converting means for mechanically converting a movement of said manually operated means to shift said guide means from the second position to the first position;

drive transmission means for driving said shifting means, said drive transmission means including a frictional clutch inducing a pair of clutch members engageable with each other with a pressure for transmitting a drive force from a drive source to said shifting means, the pressure between said pair of clutch members decreasing when said shifting means shifts said guide means to the second position; and recording means for recording an image on the sheet fed by said feeding means, wherein when the guide means is shifted to the first position, and a sheet is manually set on said tray and guided to the nip by said guide means, the sheet is fed in the first direction by said feeding means.

25. A sheet feeding apparatus comprising:

feeding means including a pair of rollers forming a nip therebetween for pinching a sheet, each of said pair of rollers being rotatable in both directions for selectively feeding the sheet in a first direction and a second direction opposite to the first direction;

guide means for guiding the sheet, said guide means being shiftable between a first position near the nip to direct the sheet toward the nip thereby to feed the sheet in the first direction by said feeding means, and a second position further away from the nip than said first position to permit advance of the sheet fed by said feeding means in the second direction; and shifting means for selectively shifting said guide means between the first position and the second position, said shifting means including manually operated means for being moved by manual operation and converting means for mechanically converting a movement of said manually operated means to shift said guide means from the second position to the first position;

wherein, when the guide means is shifted to the first position, and the sheet is manually set on said tray and guided to the nip by said guide means, the sheet is fed in the first direction by said feeding means.

26. A sheet feeding apparatus according to claim 25, wherein said shifting means shifts said guide means from the first position to the second position with a drive force transmitted from a drive source by a drive force transmission means, and said drive force transmission means also transmits the drive force to said feeding means.

27. A sheet feeding apparatus according to claim 25, wherein said drive force transmission means includes a pair of clutch members engageable with each other with a pressure for transmitting a drive force from a drive source to said shifting means, the pressure between said pair of clutch members decreasing when said shifting means shifts said guide means to the second position.

28. A sheet feeding apparatus according to claim 27, wherein said shifting means includes lever means rotatably supported for urging said guide means so as to shift said guide means.

29. A sheet feeding apparatus according to claim 28, wherein said clutch transmits the drive source to rotate said lever means for shifting said guide means.

30. A sheet feeding apparatus according to claim 29, wherein said lever means rotates to shift said guide means to the first position by a manual operation.

31. A sheet feeding apparatus according to claim 29, wherein pressure between said pair of clutch members increases when said shifting means shifts said guide means to the first position by a manual operation.

32. A sheet feeding apparatus according to claim 31, wherein said pair of clutch members slip relative to each other when said feeding means feeds a sheet in the first direction.

33. A sheet feeding apparatus according to claim 32, wherein said drive force transmissions transmits the drive source to rotate said lever means thereby shifting said guide means to the second positiion when said feeding means effects a feeding operation for feeding sheet in the second direction.

34. A sheet feeding apparatus according to claim 31, further comprising detecting means for detecting that a sheet has arrived at the nip and control means for controlling said feeding means so as to feed the sheet in the first direction according to a detection of arrival of the sheet at said nip by said detecting means.

* * * * *

UNITED STATES PATENT AND TRADEMARK OFFICE

CERTIFICATE OF CORRECTION

PATENT NO. : 5,966,158

DATED : October 12, 1999

INVENTOR(S) : TOKIHIDE EBATA, ET AL.

It is certified that error appears in the above-identified patent and that said Letters Patent is hereby corrected as shown below:

COVER PAGE AT ITEM [56] RC:
Other Publications, "Devices," should read --Devices,--.

COVER PAGE AT ITEM [56] RC:
U.S. Patent Documents, "Kanemitsue et al." should read --Kanemitsu et al.--.

COLUMN 3:
Line 45, "do so," should read --so done,--.

COLUMN 5:
Line 65, "does" should read --is--.

COLUMN 6:
Line 54, "form" should read --from--.

COLUMN 7:
Line 64, "a" should read --an--.

COLUMN 8:
Line 53, "nit" should read --nip--; and
Line 57, "a" should read --an--.

UNITED STATES PATENT AND TRADEMARK OFFICE

CERTIFICATE OF CORRECTION

PATENT NO. : 5,966,158

DATED : October 12, 1999

INVENTOR(S) : TOKIHIDE EBATA, ET AL.

It is certified that error appears in the above-identified patent and that said Letters Patent is hereby corrected as shown below:

COLUMN 9:
Line 19, "in" should be deleted;
Line 17, "upstream" (2nd occurrence) should read --downstream--; and
Line 63, "an" should read --a--.

COLUMN 10:
Line 23, "in" should be deleted.

COLUMN 16:
Line 6, "transmissions" should read --transmission means--;
Line 8, "positiion" should read --position--; and
Line 9, "feeding" should read --feeding the--.

Signed and Sealed this

Eighth Day of August, 2000

*Attest:*

*Attesting Officer*

Q. TODD DICKINSON

*Director of Patents and Trademarks*